United States Patent [19]

Morton

[11] 3,938,481

[45] Feb. 17, 1976

[54] TWO-STROKE INTERNAL COMBUSTION ENGINE

[76] Inventor: Clyde M. Morton, 11525 S. Ramona, Hawthorne, Calif. 90250

[22] Filed: Feb. 7, 1975

[21] Appl. No.: 547,790

[52] U.S. Cl. ..... 123/69 R; 123/65 BA; 123/65 R; 123/69 V

[51] Int. Cl.[2] ..... F02B 1/08

[58] Field of Search..... 123/65 R, 65 B, 65 BA, 123/69 R, 69 V, 70 R, 70 V, 73 AF

[56] References Cited

UNITED STATES PATENTS

| | | | |
|---|---|---|---|
| 2,014,678 | 9/1938 | Zoller | 123/65 B |
| 2,110,754 | 3/1938 | Alston | 123/69 R |
| 2,110,754 | 3/1938 | Garve et al. | 123/65 BA |
| 2,132,223 | 10/1938 | Slatinsky | 123/65 BA |
| 2,176,021 | 10/1939 | Grutzner | 123/69 R |
| 2,201,785 | 5/1940 | Ney | 123/69 R |
| 2,216,074 | 9/1940 | Garve et al. | 123/65 BA |

*Primary Examiner*—Wendell E. Burns
*Assistant Examiner*—David Reynolds

[57] ABSTRACT

The invention relates to internal combustion engines of the reciprocal type, and more particularly to such engines in which the pressure for Diesel operation can be attained, or in which the power output of an Otto-cycle engine can be increased.

The present invention makes possible either a Diesel engine of approximately the same axial crank offset and overall dimensions as an Otto-engine of equal throughput, or an Otto-engine having a higher throughput with slightly increased overall size and axial crank offset.

The said gas supplies are impelled by two pressure inpellers which are synchronized to engine operation, a vertical pressure impeller receives a fuel-air mixture and the inverted pressure impeller receives air, a rotary metering pressure booster meters an amount of the fuel-air mixture and forces it under pressure into a pressure retaining chamber above the cylinder chamber ready to be released upon demand.

A second rotary metering pressure booster supplying auxiliary air acts to scavenge and cool the cylinders at the end of each power stroke, as the fuel-air mixture is released from the pressure retaining chamber into cylinder chamber, and as engine speed increases an increasing amount of the auxiliary air will be trapped in the cylinder chamber and compressed together with the fuel-air mixture gradually raising the initial compression as it is compressed into the combustion chamber where it is ignited.

22 Claims, 13 Drawing Figures

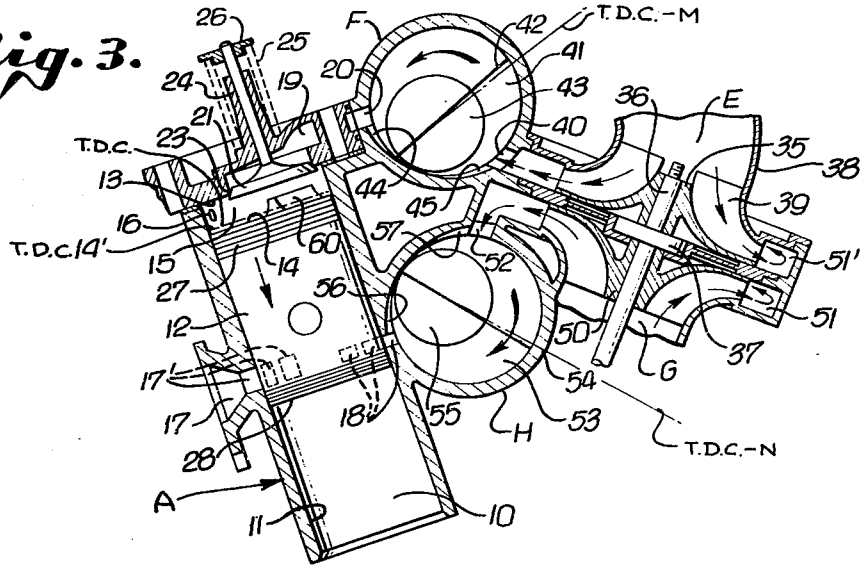
Fig. 3.
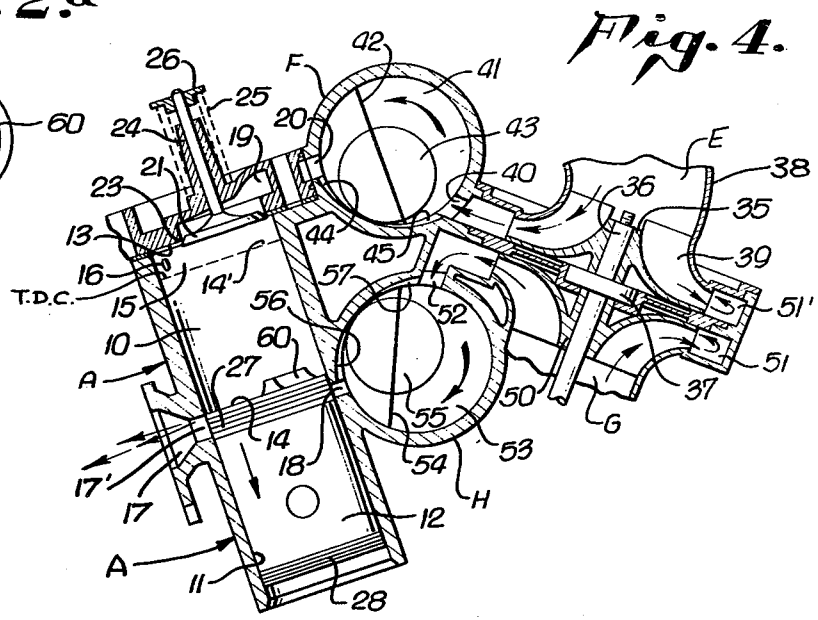
Fig. 4.
Fig. 2a.
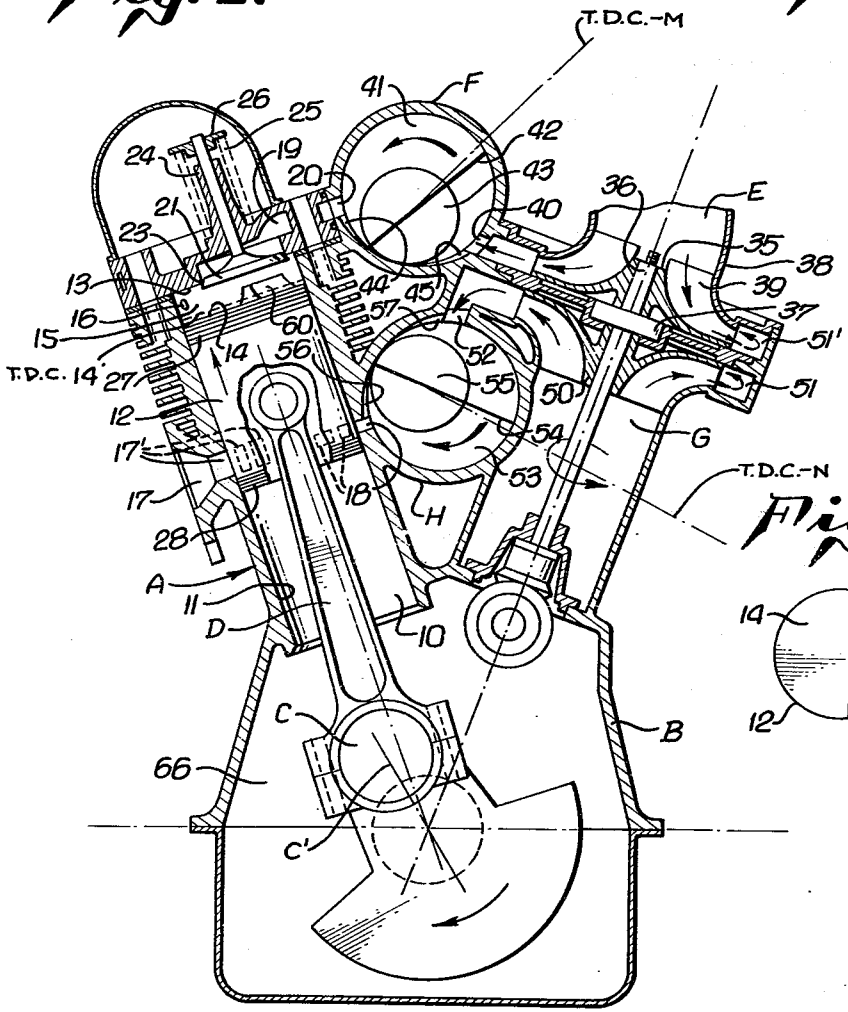
Fig. 2.

TWO-STROKE INTERNAL COMBUSTION ENGINE

For an understanding of the distinctions and advantages of the present cycle internal combustion engine attention is directed to related factors in a conventional four-cycle internal combustion engine. In such conventional engines the initial compression is highest at the starting and during idling when the engine is not under load. As load is applied head pressure builds up cutting the vacuum cycle resulting in the lowering of initial compression, thus loss of power. To compensate for this the engine is speeded up to maintain power. As more load is applied more engine speed is required. Initial compression is the term used for a pressure buildup in the combustion chamber during the compression cycle prior to ignition. When such initial compression is lowered because of loss of vacuum cycle under load, power is lost and engine efficiency is lowered.

The expression "head pressure buildup", is one used to define pressure in engine cylinder after ignition and the power stroke, which is increased as the load is increased, thus building pressure of hot expanded partly burned and unburned gases which are trapped in the engine cylinder as the exhaust valve is closed. Because there remains trapped unburned gases under pressure in the cylinder, as load is increased, the piston must descend on the vacuum cycle a distance equal to several degrees of rotation before sufficient vacuum is created to draw in a new charge of fuel. This is one of the reasons why the conventional internal combustion engine has a relatively low efficiency factor. As load is increased on such an engine the head pressure continues to increase necessitating that the piston descend still further on the vacuum cycle before adequate vacuum can be created and this adds to the loss of engine efficiency.

The new charge of fuel is curtailed by reason of unburned trapped gas remaining in the combustion chamber, a factor causing a great loss in engine efficiency and contributing to the creation of pollutants such as oxides of nitrogen not readily subject to elimination by additives.

Inability of the conventional engine to acquire sufficient oxygen to completely burn a depleted fuel charge caused by the residue of half burned gas trapped in the combustion chamber, combined with the new charge of fuel in which an air supply is curtailed as a result of head pressure buildup causing loss of vacuum cycle thereby cutting air supply, is a circumstance adding to the pollution problem.

Among the objects of the present invention is to eliminate the inherent defects above made reference to that exist in present internal combustion engines.

It is an object of the present invention to provide a reciprocal type engine in which the intake volumes of substantially two working chambers are compressed into a single working power chamber.

Another object is to provide a reciprocating type engine as described in which two working pressure chambers intake simultaneously through two separate intake ports aided by two continuously operative pressure impellers to maintain continual pressure on the two liquid supply lines serving said pressure chambers.

A further object of the invention is that the said working pressure chambers are virtually rotary metering pressure booster chambers in said liquid supply lines making it possible for Diesel design and the boosting of power output in the Otto-cycle engine.

Still another object of the invention is to provide a reciprocal type engine as described capable of Diesel operation.

Still another object of the invention, an outstanding feature is the providing of a cool running air cooled Otto-cycle engine and the innovation of an air cooled Diesel engine while operating under heavy load, made possible by the act of compression and expansion creating an abundance of real cold air and fuel being forced through cylinders each operative cycle, cooling from the inside out eliminating the need for water pump and radiator and their accessories.

Another object of the invention is to provide a two-stroke engine which needs no vacuum cycle, all functions of which operate under continual varied pressures thereby as a result, among many of its accomplishments is that engine noises are minimized.

Another object of the invention is to provide a new and improved two-stroke internal combustion engine capable of delivering high torque at low engine speed wherein an increased load on the engine will not affect initial compression.

Another object of the invention is to provide a new improved two-stroke internal combustion engine which is of a structure and operation such that it is not necessary to increase engine speed to maintain power under load however, by increasing engine speed much greater power is produced.

It is a further object of the invention to provide a new and improved two-stroke internal combustion engine which operates without a vaccum cycle and therefore avoids need for oil rings on the pistons to prevent oil from being drawn from the crank case into the cylinder chamber.

Another object of the invention is to provide a new and improved two-stroke internal combustion engine wherein burned gas fumes or raw gasoline will not pass into the crank case.

Another object of the invention is to provide a new and improved internal combustion engine which runs relatively cleaner than conventional internal combustion engines, avoids carbon deposit in the combustion chamber, on the valve head or on the piston head and wherein carbon will not accumulate under the piston rings as a result of insufficient oxygen.

Also included among the objects of the invention is to provide a new and improved internal combustion engine in which the cylinder chamber is completely evacuated and scavenged after each power stroke.

Still another object of the invention is to provide a new and improved internal combustion engine which requires only one valve for each cylinder in a relationship and operational sequence such that in sequence very cold fuel-air charges are retained above the valve and no hot gases ever pass through the valve whereby the valve runs cool at all times.

Still another object of the invention is to provide a new and improved two-stroke internal combustion engine which maintains much greater efficiency without need for heating the fuel-air mixture before passing it along into the cylinder chamber where it will be compressed into the combustion chamber.

With these and other objects in view, the invention consists in the construction, arrangement, and combination of the various parts of the device, whereby the objects contemplated are attained, as hereinafter set forth, pointed out in the appended claims and illustrated in the accompanying drawings:

FIG. 2 is a longitudinal sectional view showing the engine in association with a conventional crank shaft;

FIG. 2*a* is a plan view of the top of the piston head;

FIG. 3 is a longitudinal sectional view of operating parts of the two-stroke internal combustion engine showing the positions of the parts at the beginning of a power stroke;

FIG. 4 is a longitudinal sectional view similar to FIG. 3 near the end of the power stroke;

FIGS. 5, 6, 7 and 8 are longitudinal sectional views similar to FIGS. 3 and 4 but showing progressive small increments of movement of the piston in the opening of the exhaust and scavenging ports and the closing of said ports.

Figure 9:
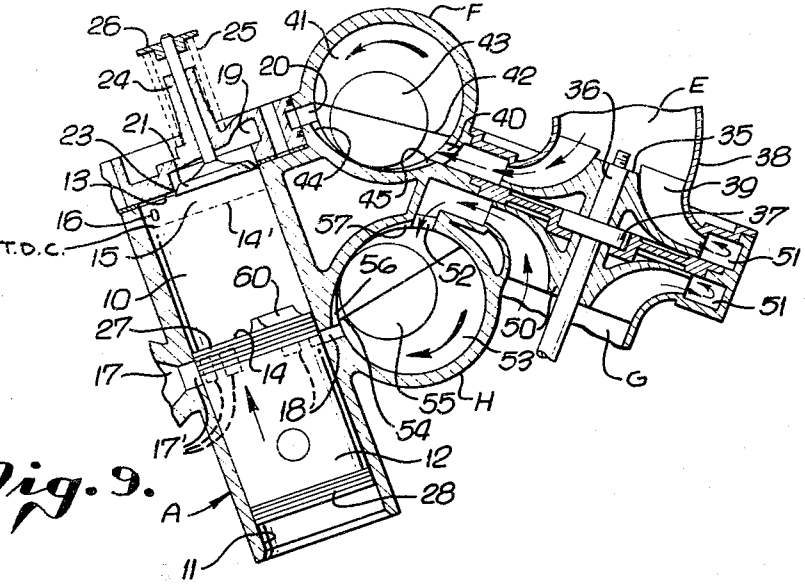

FIG. 9 is a longitudinal sectional view similar to FIG. 3 showing the piston position at closing of the valve, 10° after the commencement of the compression stroke.

Figure 10:
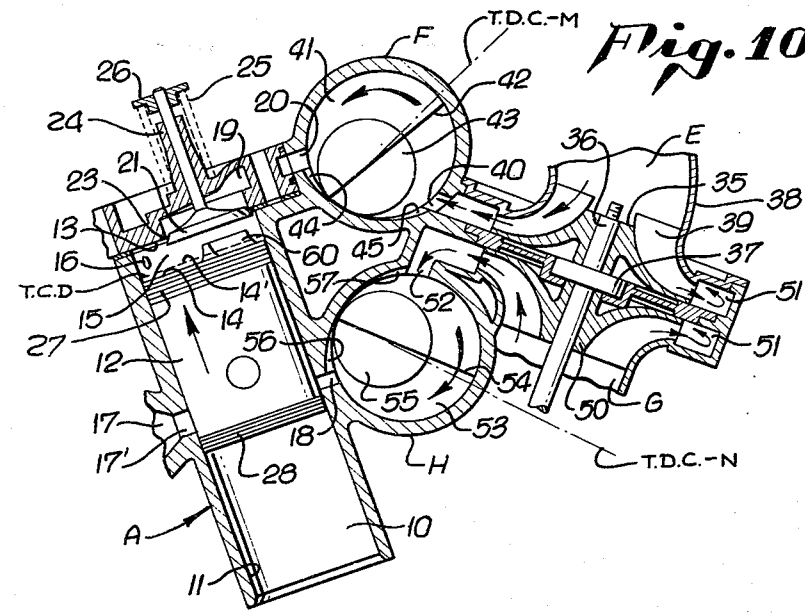

FIG. 10 is a longitudinal sectional view similar to FIG. 9 at near completion of the compression stroke showing position of piston at time of ignition when running at high speed, 10° before top dead center.

Figure 11:
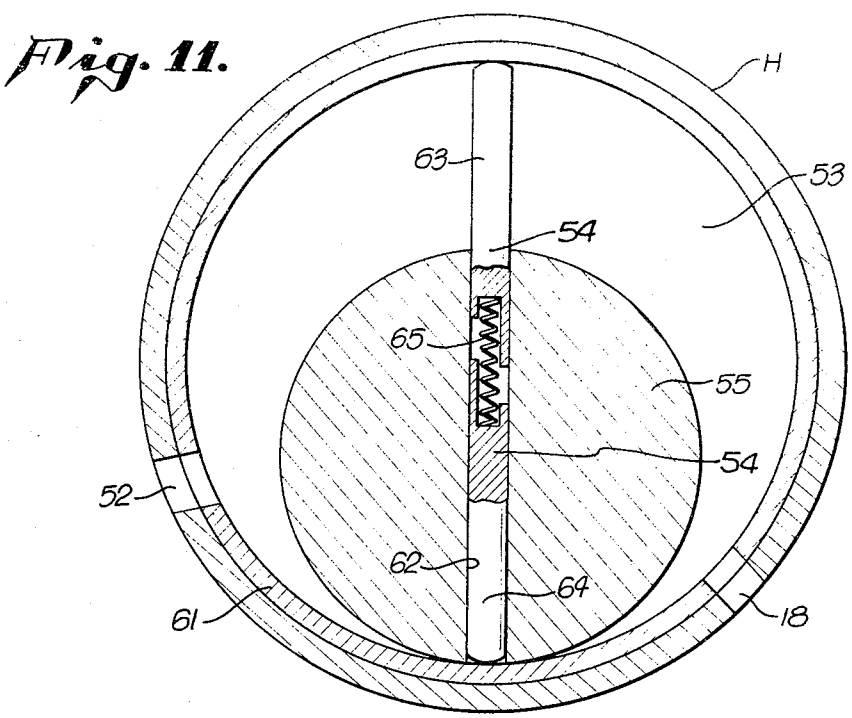
Figure 12:
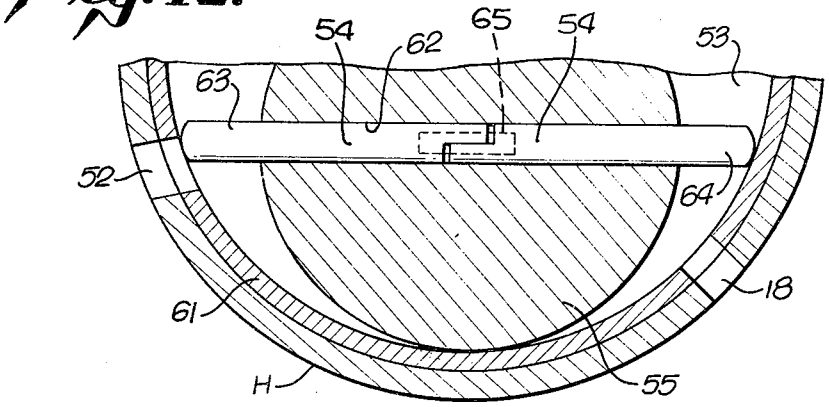

FIGS. 11 and 12 are cross-sectional views of one of the rotary metering pressure boosters used with the engine, namely booster H.

In an embodiment of the invention chosen for the purpose of illustration there is shown a two-stroke internal combustion engine indicated generally by the reference character A mounted in a housing B for rotating a conventional crank shaft C by means of a conventional connecting rod D. A fuel-air mixture source E feeds a fuel-air mixture to the engine through a rotary metering pressure booster F and a scavenging air source G feeds scavenging air to the engine through a rotary metering pressure booster H. The various operating parts are interconnected by conventional means (not shown) so that they operate in properly timed relationship.

Except for positions of the moving parts and omission of conventional features all of FIGS. 3 through 10 inclusive are substantially the same as FIG. 2.

As shown in the drawing a power cylinder 10 has a piston 12 which reciprocates for driving the crankshaft C through the connecting rod D, previously made reference to. Cylinders 10 are normally arranged in a V-block formation, however, the engine can be built in an inline formation. All moving parts are synchronized with the crankshaft C in timed relationship by conventional means (not shown). All cylinders 10 are structurally the same and the pistons 12 operate in the same fashion therefore the details of only one will be described.

A combustion chamber 15 is formed between the engine head 13 and piston head 14, when piston 12 is at top dead center. A conventional spark plug at the location 16 serves to ignite the fuel-air mixture in the combustion chamber.

A large exhaust outlet 17 having multiple ports 17′ through cylinder wall 11 converging into said large outlet 17 extends outwardly from cylinder wall 11 and the multiple scavenging ports 18 feed through the cylinder wall 11 at a location diametrically opposite the said multiple exhaust ports 17′.

Figure 6:
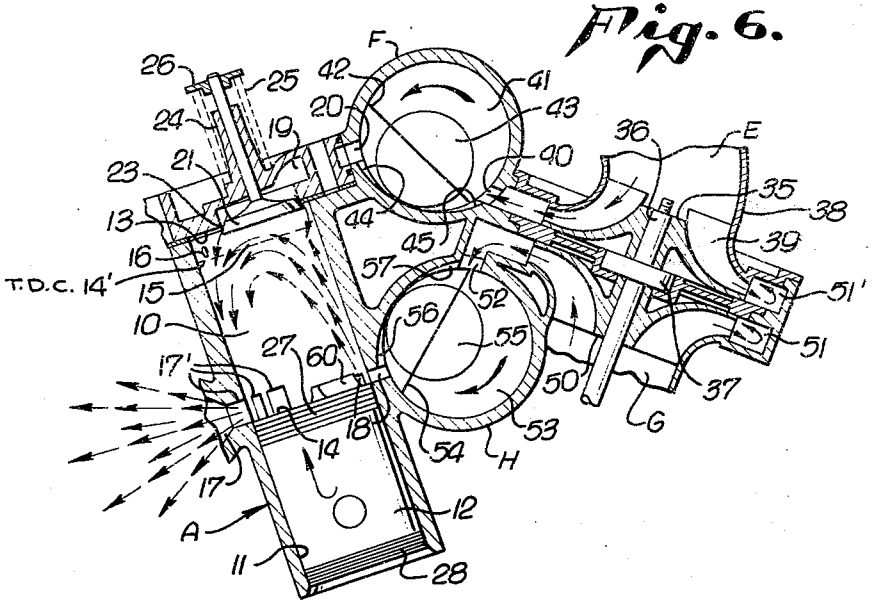

A baffle 60 on the piston head 14 of piston 12 is located spaced from cylinder wall 11 at the location of the scavening port 18 and in line with the scavenging port 18 when piston is at bottom of stroke as shown in FIG. 6.

As shown the piston 12 is provided with a set of compression rings 27 and another set of rings 28 on skirt of piston 12 to prevent air from seeping into crank case 66 as the air under pressure in said ports 18′ skirts piston 12 and passes out said exhaust ports 17′ aiding in cooling piston 12 and cylinder 10 this loss of air for a valuable cause is provided for.

A fuel pressure retaining chamber 19 is built into the engine head 13 to retain the oncoming fuel as pressure builds up for next fueling cycle. A pressure retaining valve 21 adapted to seat on valve seat 23 on underside of engine head 13 in combustion chamber area 15, valve 21 stem extends up through chamber 19 and on up slidingly through valve guide 24 on top of engine head 13. A spring 25 around guide 24, applying pressure between top of engine head 13 and keeper 26 on end of valve 21 stem drawing valve 21 firmly against seat 23 sealing pressure retaining chamber 19, retaining said fuel for delivery on demand. Valve being operated by overhead cam (not shown).

To feed a fuel-air mixture to the cylinder chamber 10 from the fuel-air mixture source E use is made of a vertical pressure impeller 35 mounted on a rotating impeller shaft 36, the impeller shaft being journaled in a bearing 37. In an impeller housing 38, impeller blades 39 are constructed so as to draw from the fuel-air mixture source E and impell the mixture under pressure in a turbulent condition in vein 51′, thoroughly dispersing and churning said mixture into gaseous particles creating a volatile fuel-air mixture which is forced through port 40 into a rotary metering pressure booster F, where the metered supply of said volatile mixture is compressed again the second time by the said rotary metering pressure booster F, as it is being forced through port 20 into pressure retaining chamber 19, from where it is released on demand into cylinder chamber 10. The said cylinder chamber 10 having been thoroughly scavenged and filled with cold clean air, as the volatile fuel-air mixture is released from said chamber 19 through pressure retaining valve 21, expanding as mixing with the clean auxiliary oxygen ladened air in cylinder chamber 10 further cracking the said volatile fuel-air mixture, increasing volatility, lightness, thus more readily vaporized. As the piston 12 compresses the prepared volatile fuel-air mixture the third time, as it is compressed in the combustion chamber 15 under drastically increased initial compression before ignition, producing a clean burning fuel delivering more miles and power on less fuel, producing a powerful Otto-cycle engine and/or a Diesel engine with clean emissions.

An extendable and retractable blade member 42 carried by a rotor 43 in the pressure booster chamber 41, its travel speed is one-half the travel speed of piston 12, therefore one end of the extendable and retractable blade 42 preforms its function and then the other which serve to meter, compress and deliver quantities of said volatile fuel-air mixture through port 20 into pressure retaining chamber 19. The direction of rotation of the blade member 42 is indicated by the arrow in FIG. 2 and the related figures.

Veins 44 in the wall of the booster chamber 41 extend from the mixture supply port 20 at a progressively diminishing depth in the direction of rotation of the blade 42. Veins 45 extend from the fuel-air mixture port 40 at a progressively diminishing depth in a direction counter to the direction of rotation of the blade 42.

An inverted pressure impeller 50 also mounted on the impeller shaft 36 serves to draw air from the air source G and forces the air into an annular vein 51 and thence on through port 52 into a booster chamber 53 of the rotary metering pressure booster H. In the booster chamber 53 is an extendable and retractable blade member 54 carried by and moved by action of a rotor 55 in the direction of the arrow shown within the booster chamber 53.

The travel speed of the extendable and retractable blade member 54 is one-half the travel speed of piston 12, therefore the ratio of piston 12 travel to the blade member 54 is 2 to 1 prolonging the life of blade member 54 which serves to meter, compress and deliver large quantities of real cold air, made so by rapid compression and expansion, said air metered and delivered through scavenging ports 18 at the end of each power stroke, is of the amount equal to piston 12 displacement and the combustion chamber 15 area plus 5 cubic inches, sufficient to completely purge cylinder 10 and force residue out the multiple exhaust ports 17', and at the same time the real cold air is cooling cylinder 10 from the inside out.

As the piston 12 is at bottom dead center and the cylinder 10 is filled with clean oxygen ladened air, as previously mentioned, the pressure retaining valve 21 starts opening by mechanical means (not shown) admitting a real cold fuel charge from the pressure retaining chamber 19, which is also chilled by rapid compression and expansion, as the volatile mixture under pressure leaves chamber 19 expanding. The mixture is thus further cracked, increasing volatility, lightness and thus more readily vaporized. As the mixture expands into the said oxygen laden air and together the still incoming scavenging air and the fuel charge continues forcing the remaining residue out the exhaust ports 17'. As the scavenging port 18 closes, the incoming fuel continues forcing a portion of the clean scavenging air out of the multiple ports 17', as the piston 12 closes the exhaust ports 17'. The said volatile fuel is again compressed the third time by piston 12 into the combustion chamber 15 where it is ignited by spark plug 16 in the Otto-cycle engine.

The engine is started under relatively low initial compression, at electric starter speed. Immediately as engine starts, initial compression will increase to approximately 200 lbs. initial compression before ignitiion, and as engine speed is increased, initial compression will increase gradually as engine speed is increased, until reaching a levelling of speed of approximately 2300 RPM to 2800 RPM, obtaining initial compression of 300 to 350 lbs. before ignition. After levelling off, regardless of increased speed, initial compression remains at levelling off of pressure attained. As stated this performance can be increased or decreased by minor adjustments of pressure and quantity of auxiliary air made available.

Veins 56 in the wall of the booster chamber 53 extend from the cylinder scavening port 18 at a diminishing depth in the direction of rotation of the blade member 54. Similar veins 57 extend from the scavening booster port 52 at a progressively diminishing depth in a direction opposite to the direction of rotation of the blade member 54.

Details of the rotary metering pressure booster H for example, are shown in FIGS. 11 and 12 wherein a sleeve 61 on the interior which provides spacing means for spacing end-plates (not shown) for separating the booster chambers when more than one booster in line is required, said sleeve forming the booster chamber 53. In the rotor 55 which is preferably cylindrical, there is provided a transverse slot 62 for accommodation of the blade member 54. In practice the blade member consists of two blade elements 63 and 64 respectively, slidably contained in the slot 62 and biased outwardly so that outer ends slidably engage the interior of the rotary metering pressure booster chamber 53 by action of a spring 65. The blade member in its most contracted position is shown in FIG. 12, and in its most extended position in FIG. 11.

The two previously mentioned liquid gas supply sources E and G activated by two pressure impellers 35 and 50 deliver said liquid gases to two rotary metering pressure boosters F and H as described in present invention for boosting the power of and creating a cool running air cooled Otto-cycle engine of a given throughput which also makes possible an air cooled innovation for Diesel operation of equal throughput with the same axial crank offset and overall dimensions of the Otto engine, but understandably, increasing the strength of crankshaft C connecting rods D pistons 12, housing B, bearings and gearings to the rotary metering pressure boosters (some of the parts now shown). The Diesel engine is made possible because of the said liquid gas pressure supply units namely, the two rotary metering pressure boosters F and H in conjunction with the said vertical and inverted pressure impellers. The vertical pressure impeller 35 will provide real cold air only for Diesel pressure buildup instead of the volatile fuel-air mixture, while the inverted pressure impeller continues to supply real cold auxiliary air for scavenging and cooling plus an additional amount of air to aid in pressure buildup producing a cool running air-cooled innovation for Diesel operation. A conventional available fuel injector is used for Diesel operation, taking the place of the electric spark plug 16 used for the Otto-cycle engine. Greater power can be obtained by increasing the size and number of cylinders and increasing the axial crank offset and overall dimensions will meet any demand for Diesel or Otto engine power plants.

Figure 1:
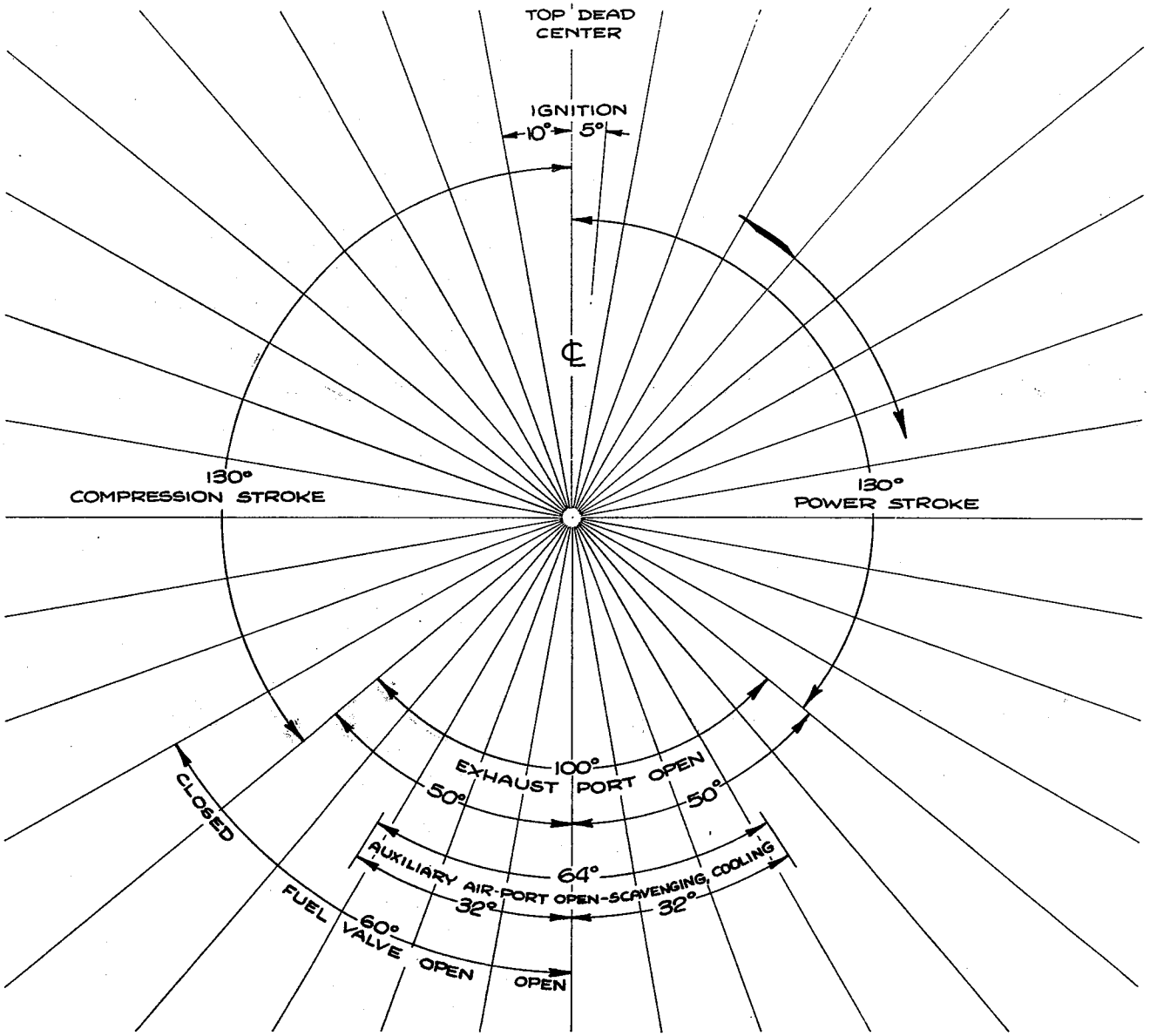
FIG. 1 is a diagram of significant points in the two-stroke engine operation.

The following is a description of operation of the invention:

The complete operation of the invention is shown sequentially in FIGS. 3 to 10 with FIG. 1 as a supplementary guide chart, explanatory of the sequential movement. The invention is peculiar in that it has no vacuum cycle, therefore explanation of operation starts with ignition, that is, the power stroke.

In FIG. 3 first note the dotted line 14' which also shows in FIG. 4 as a level from which piston descended. The dotted line 14' is indicative of top dead center (TDC). In FIG. 3 TDC-M and TDC-N also are indicative of top dead center of rotor booster blades 52-F and 54-M. The piston 12 has moved down slightly as the crank axial offset just passed top dead center 5°, shown in FIG. 1. Spark plug 16 has fired, expansion has moved piston 12 down on the power stroke to the position of FIG. 4, shown in chart FIG. 1 at 130°.

At this same time the vertical pressure impeller 35 is drawing fuel-air mixture from the passage E and forcing it into the vein 51' in a turbulent manner, thoroughly dispersing and churning said mixture into gaseous particles creating a volatile gaseous mixture, which is forced through port 40 into chamber 41 of rotary metering pressure booster F against the extendable and retractable motor booster blade 42 drive by rotor 43 in chamber 41 where it will be metered. The fuel in front of rotor booster blade 42 is being compressed and forced through port 20 into the pressure retaining chamber 19, in the cylinder head 13, where it will be retained for next demand for fuel. Chamber 19 is sealed by the pressure retaining valve 21, which is drawn against the valve seat 23 on underside of cylinder head 13 in the combustion chamber area 15, held by spring 25 acting between exterior of cylinder head 13 and the keeper 26 on top end of valve 21 stem sealing pressure retaining chamber 19.

The lower end of the rotor booster blade 42 passes over vein 44 preventing pressure buildup on rotor booster blade 42. Also at the same time the inverted pressure impeller 50 is drawing air through the passage G and forcing said air into the vane 51 on through port 52 into chamber 53 of the rotary metering pressure booster H and against the retractable rotor booster blade 54 driven by rotor 55 where it can be metered. The air in front of booster blade 54 is being compressed for scavenging and cooling cylinder 10. Air that skirts around the piston 12 and passes out the multiple exhaust port 15 aids in cooling the piston 12. This loss of air serves a valuable purpose and is accounted for. The skirt rings 28 prevent air from seeping into the crankcase 66, shown in FIG. 2.

Dotted line 14' in FIG. 4 from which piston 12 descended defines the combustion chamber area 15. The piston 12 has moved down on the power stroke to the multiple ports 17' shown in chart FIG. 1 at 130°. Exhaust is starting to seep through the outlet 17 and the inverted pressure impeller 50 continues to force air through the port 52 maintaining pressure in chamber 53 in booster H against rotor booster blade 54. As the air in front of blade 54 is being compressed in scavenging ports 18 of the chamber 53, and the upper end of rotor booster blade 54 is passing over vein 57 preventing vacuum drag on blade 54 till blade 54 reaches port 52. At the same time the vertical pressure impeller 35, has been drawing fuel-air mixture through passage E forcing said volatile mixture through the port 40 into and maintaining pressure in chamber 41 of metering pressure booster F. The front of the booster blade 42 is forcing a metered charge of said volatile mixture through port 20, into pressure retaining chamber 19 where it is retained. The lower end of rotor booster blade 42 passes over vein 45, preventing vacuum drag till blade 42 reaches port 40.

Figure 5:
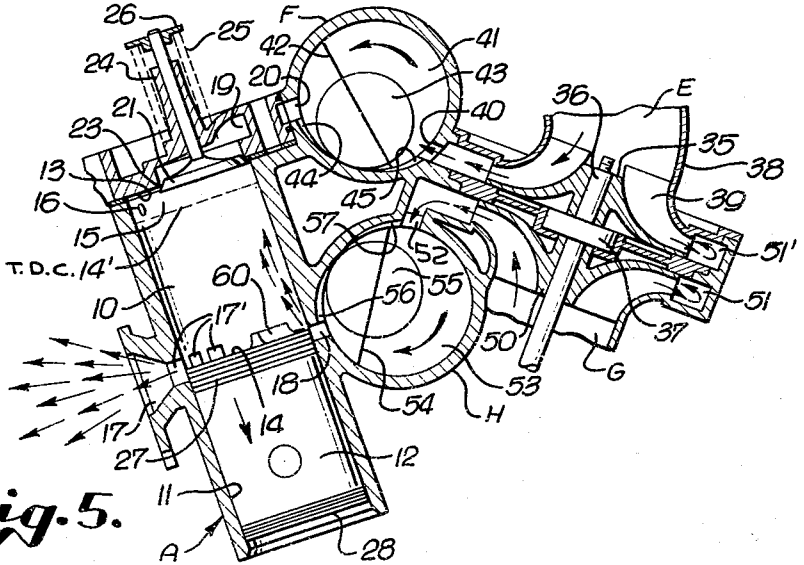

The multiple scavenging ports 18, as shown in FIG. 5, have been reached by the descending piston 12, note chart FIG. 1, 32° before end of stroke. The spacious multiple ports 17' started opening as shown in FIG. 4, and exhaust has been and is being rapidly expelled through outlet 17. The inverted pressure impeller 50 continues forcing air through port 52 into and maintaining pressure in chamber 53 of metering pressure booster H. Air in front of booster blade 54 has reached peak pressure, indicated by air starting through scavenging ports 18, and is directed up by baffle 60 on piston head 14.

The upper end of rotor booster blade 54 passes over the vein 57 preventing vacuum drag till blade 54 reaches port 52. The vertical pressure impeller 35 continues drawing fuel-air and forcing said volatile mixture through port 40 into and maintaining pressure in chamber 41 of metering pressure booster F. A metered charge of said volatile mixture in front of booster blade 42 is forced through port 20 into pressure retaining chamber 19 where it is retained waiting a demand for fuel. As the lower end of rotor booster blade 42 is passing over vein 45 it prevents vacuum drag until the booster blade 43 reaches port 40.

Piston 12, as shown in FIG. 6, has uncovered both ports 17' and 18 at the end of the stroke, note chart FIG. 1, permitting rapid expulsion of exhaust through ports 17' passing out outlet 17, as real cold air created by rapid compression and expansion has been passing through ports 18 since ports 18 started opening as shown in FIG. 5. Said baffle means 60 has been directing air upward, filling and purging the combustion chamber 15 and surging downward to ports 17', thoroughly scavenging and cooling cylinder 10 and providing clean oxygen laden air to receive the incoming cold volatile fuel mixture.

Note that chart FIG. 1 indicates that the valve 21 starts opening at bottom dead center. The pressure impeller 50 continues maintaining air pressure in the chamber 53, and rotor booster blade 54 driven by rotor 55 continues forcing air through ports 18. The vertical pressure impeller 35 maintains pressure in chamber 41. The position of the rotor booster blade 42 driven by rotor 43 indicates that peak pressure has been reached in the rotary metering pressure booster F and arrows indicate the valve 21 is starting opening. The lower end of rotor booster blade 42 passes over the vein 45 preventing vacuum drag on blade 42 until the blade 42 reaches port 40.

Figure 7:
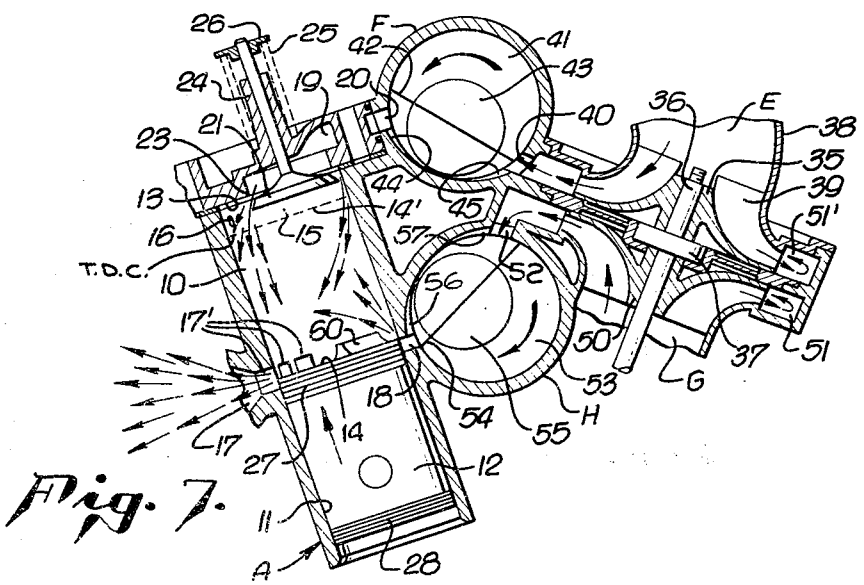

Piston 12, as shown in FIG. 7, has ascended, partly closing exhaust ports 17' and the scavenging ports 18 are closing, note chart FIG. 1, 32° past center line. Since the last position FIG. 6 where valve 21 was opening, during this interval of time both the scavenging air and the fuel charge together have been forcing residue through the multiple exhaust parts 17' and on out through outlet 17. The cold incoming volatile fuel from valve 21 continues to apply pressure forcing residue out ports 17'. The said cold volatile fuel is also created by rapid compression and expansion, further cracking said fuel before final compression and ignition. When the rotary metering pressure booster H has expended its charge, note that the rotor blade 54 is at edge of ports 18 and the upper end of rotor blade 54 has passed port 52. The rotary metering pressure booster H has therefore metered a new charge of air for scavenging and cooling the next power stroke. The inverted pressure impeller 50 continues forcing air through the port 52 into chamber 53 and maintaining pressure behind rotor booster blade 54 for still another power stroke.

The rotor blade 42 of the rotary metering pressure booster F, however, continues to force fuel through the passages into cylinder 10 and the vertical pressure impeller 35 continues drawing fuel-air mixture and forcing said volatile mixture through port 40 maintaining pressure in the chamber 41 of the rotary metering pressure booster F.

Figure 8:
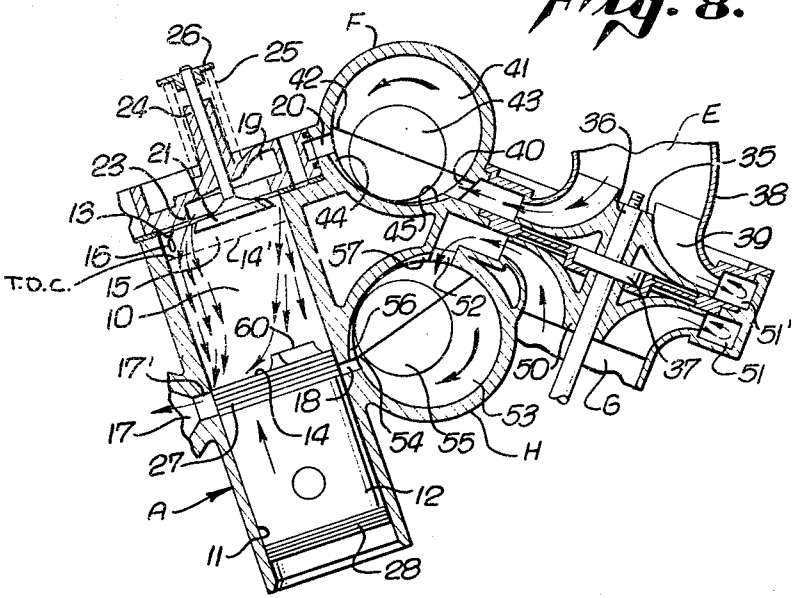

As shown in FIG. 8 the piston 12 is closing multiple exhaust ports 17'. Note on the chart FIG. 1 that the exhaust ports 17' are closed 50° past the center line. The pressure retaining valve 21 is still open a trifle and fuel is still being forced through the passages to the cylinder 10 by the upper end of the rotor blade 42 driven by rotor 43. The lower end of rotor blade 42 has passed the port 40, therefore the chamber 41 in the rotary metering pressure booster F has received its metered charge of said volatile mixture for next power stroke.

As the vertical pressure impeller 35 continues drawing fuel-air mixture through passage E and forcing mixture into vein 51' in a turbulent manner this produces a volatile mixture which is forced through the port 40 maintaining pressure in the chamber 41 behind the rotor blade 42 in the booster F for still another power stroke. As rotor blade 54 driven by motor 55 in booster H is beginning to pass over vein 46, that prevents pressure buildup in front of rotor blade 54. The inverted pressure impeller 50 continues to force air through port 52 maintaining pressure in chamber 53 behind rotor blade 54 in booster H.

As shown in FIG. 9, the piston 12 has ascended 10° more on the compression stroke. Note that on the chart FIG. 1 the pressure retaining valve 21 has closed 60° past bottom dead center, being held firmly on the seat 23 by the spring 25 sealing the pressure retaining chamber 19 ready for the oncoming metered fuel charge from the rotary metering pressure booster F. As the vertical pressure impeller 35 continues its function, the rotor blade 54 in booster H continues passing over vein 56 preventing pressure buildups in front of rotor blade 54 and the inverted pressure impeller 50 continues its function.

As shown in FIG. 10, the piston 12 has ascended on the compression stroke to within 10° of top dead center. Note that the chart FIG. 1 shows this position 10° of top dead center. This is the ignition point when running the engine at high speed with the spark 16 fully advanced. At high speed as ignition takes place 10° of top dead center the axial crank offset C' shown in FIG. 2 will have passed top dead center 5° as note the showing on the chart FIG. 1, before expansion takes effect forcing the piston 12 down on the power stroke as shown in FIG. 4.

The lower end of the rotor blade 42 driven by the rotor 43 in the chamber 41 of the rotary metering pressure booster F has just passed over the vein 44 preventing pressure buildup in front of rotor blade 42. The upper end of rotor blade 42 is boosting the metered charge of volatile mixture through the port 20 into the pressure retaining chamber 19 to be retained for next fueling cycle.

As the vertical pressure impeller 35 continues drawing fuel-air mixture through passage E and forcing in turbulent manner into vein 51' thoroughly dispersing and churning said mixture into a volatile mixture, which is forced through the port 40 maintaining said volatile mixture under pressure in the chamber 41 of the booster F. As the inverted pressure impeller 50 continues to draw air through the passage G the air is forced into the vein 51 on through port 52 into and maintaining air pressure in the chamber 53 against the rotor blade 54 which is driven by the rotor 55 of rotary metering pressure booster H and the rotor blade 54 is compressing air for scavenging next power stroke. The piston 12 is travelling its course and as air is compressed and some air will skirt piston 12 passing out the multiple exhaust ports 17' aiding in cooling piston 12 and cylinder 10. The skirt rings 28 will prevent air from passing into the crankcase 64 shown in FIG. 2. This loss of air has been provided for intentionally.

A high speed run as shown in FIG. 10, as above described, will take the place of FIG. 3 and from here on it is a repeat of the first starting run on which ignition took place 5° past top dead center, as shown in chart FIG. 1 and in FIG. 3.

In addition to the basic operation as has just been described, it should be understood that as the engine speed is increased more of the scavenging air will be trapped in the cylinder chamber 10 and compressed, raising the initial compression, namely, the pressure in the combustion chamber area 15 just before ignition. As engine speed continues to increase initial compression will continue to increase and more scavenging air is trapped. Engine speed and as a consequence piston travel, overtakes the travelling speed of air through given size metering ports under a given pressure, the pressure being maintained through the varying engine speeds by operation of the inverted pressure impeller 50 in conjunction with the rotary metering pressure booster H which varies with engine speed. As piston travel speed surpasses the travel speed of incoming scavenging air from pressure booster H more cool air is trapped in the cylinder gradually raiasing engine initial compression as the speed is increased.

In an engine of this design astronomical pressures may be obtained. Pressures of 300 to 350 lbs. in the combustion chamber before ignition is the top pressure advisable for an Otto engine type. This avoids the possibility of spontaneous combustion but approaches pressures prevalent in Diesel design. The initial compression can be increased or decreased by minor adjustments of pressures by the quantity of auxiliary air provided. By reason of design, peak pressures as have been indicated are reached. The engine levels off between 2300 to 2800 R.P.M. No further increase in pressure will develop, regardless of further increased engine speed.

The cooling action from rapid compression and expansion will cause frost on parts producing said action at high engine speeds, namely, at the area of the scavenging ports in cylinder wall in conjunction with booster H, and the area of the pressure retaining chamber in engine head in conjunction with booster F. Heat from the exhaut manifold can be redirected to said areas which may be too cool. The engine operation is such as to create a cool running engine while operating under heavy load. An ample supply of oxygen continues to be supplied inducing complete burning of the fuel coupled with there being a longer burning time by reason of a longer stroke and lowered RPM.

In an engine of the design herein described it is not possible for head pressure buildup to occur. The cause of head pressure buildup reference is set forth in paragraphs one and two of the Specification. This is a serious smog producing defect that has plagued the present four cycle conventional internal combustion engine since its conception, and which is the main cause of the low engine efficiency obtained in the conventional four cycle engine. The elimination of head pressure buildup in the engine herein described is achieved by the generous quantity of real cold scavenging air which not only evacuated all residue from the cylinders but also creates the cooling of the cylinders from within making it possible to eliminate the radiator and water circulating pump and their accessories. The arrangement makes possible a cool running air cooled Otto-cycle engine and also an air cooled Diesel engine of the same axial crank offset and overall dimensions as the Otto-cycle engine. This is made possible by the presence of said pressure impellers 50 in conjunction with the said rotary metering pressure boosters H.

The following will help set forth the outstanding principles in the conventional internal combustion engine and the recent development herein described and should be clearly understood.

Because of head pressure buildup that occurs in the present conventional internal combustion engine as load is applied there is a loss of vacuum cycle. Therefore the piston must descend on the vacuum cycle a distance equal to several degrees of rotation before sufficient vacuum is created to draw in a new charge of fuel mixture. The new charge of fuel is curtailed and depleated by the hot expanded partly burned and unburned gases remaining in the combustion chamber. This makes it impossible for the conventional internal combustion engine to ever receive 100 percent clean fuel charge equal to engine piston displacement.

In contrast to the foregoing, the new development herein disclosed is one in which it is impossible for head pressure to ever occur, because after each power stroke the cylinder is cleaned and cooled with a predetermined quantity of cold auxiliary oxygen laden air to receive the incoming fuel-air mixture. The amount of oxygen laden air is greater than the 100 percent of piston displacement, the said fuel-air mixture being a predetermined quantity which never varies regardless of load applied, giving the assurance of continued power under increased load, though engine speeds may be varied as desired.

The structure and functioning of the engine of the specification exemplifies a method of operation wherein cold auxiliary air is provided for both a Diesel type machine and an Otto-cycle engine type for complete scavenging and cooling from within. Auxiliary air is supplied and makes possible an invalauable means of providing low initial compression in the combustion chamber for easy starting whereby, immediately upon starting, initial compression is drastically increased by the said metered supply of auxiliary air and volatile fuel-air mixture is forced into cylinder chamber, the instantly and drastically increasing power for quick pickup.

The fuel-air mixture and auxiliary air are predetermined metered quantities, and will not vary with engine speed or lead applied, thus eliminating of head pressure buildup which would otherwise reduce power and engine efficiency. As a consequence power will be maintained under the load without having to increase engine speed to maintain power. By increasing engine speed initial compression is increased, greatly increasing power while under load.

The invention provides the advantage that the necessary pressure for Diesel operation may be attained without increasing the overall dimensions of the engine, or that a greater throughput for Otto-cycle operation may be obtained. Further, no additional porting is required, and currently available injection and ignition systems and other accessories may be used. Additionally the crankshaft, drive shaft, couplings, gearing of rotors, engine block and/or housing can be made substantially stronger in the Diesel machine of the invention than in the corresponding Otto-cycle type.

Although the invention has been described in a preferred embodiment, it will be understood that it is not limited to the device shown and described, and that various changes and modifications may be made by those skilled in the art without departing from the scope of the invention. It is intended to cover all such modifications to the appended claims.

I claim:

1. In a reciprocating two-stroke multiple cylinder internal combustion engine having a housing, a cylinder having a piston reciprocably mounted in the cylinder for movement alternately through compression and power strokes, said piston forming one end of a combustion chamber area when the piston is at top dead center, said cylinder having multiple exhaust ports through said cylinder wall and multiple scavenging air ports into said cylinder chamber, a supply port to said cylinder chamber for a fuel-air mixture, a pressure retaining chamber between said supply port and said cylinder chamber, and a pressure retaining valve means between said pressure retaining chamber and said cylinder chamber biased normally to closed position against pressure in said pressure retaining chamber, a fuel-air mixture supply line to said supply port including means for keeping said supply line under pressure, a continuously acting rotary metering pressure booster in said supply line having a metered capacity sufficient to fill said cylinder chamber when said piston is at the bottom of the stroke, a scavenging air line to said multiple scavenging ports including means for keeping said scavenging air line under pressure and a continuous acting rotary metering pressure booster in said scavenging air line having a metered capacity slightly in excess of said cylinder chamber when said piston is at bottom end of stroke, said second recited means being operable to cycylically supply scavenging air to said cylinder chamber at the end of the power stroke, said multiple exhaust and multiple scavenging ports being subject to opening and closing in response to movement of said piston, said rotary metering pressure boosters and said piston being operable in timed sequence to feed fuel-air mixture and scavenging air to said cylinder chamber sequentially.

2. A reciprocating two-stroke internal combustion engine as in claim 1, wherein the metered capacity of the rotary metering pressure booster in the fuel-air supply line is of the capacity of the engine displacement plus the combustion chamber area.

3. A reciprocating two-stroke internal combustion engine as in claim 1, wherein the metered capacity of the rotary metering pressure booster in the auxiliary scavenging air supply line is slightly in excess of the capacity of the engine displacement plus the combustion chamber area.

4. A reciprocating two-stroke internal combustion engine as in claim 3 wherein the excess is substantially 10%.

5. A reciprocating two-stroke internal combustion engine as in claim 1, wherein the multiple exhaust ports and the multiple scavenging ports have positions relative to each other providing opening of the scavenging ports after the exhaust ports are partially open and before the exhaust ports are fully open.

6. A reciprocating two-stroke internal combustion engine as in claim 5, wherein the positions of the multiple exhaust and scavenging ports provide full opening of the multiple scavenging ports when the multiple exhaust ports are fully open.

7. A reciprocating two-stroke internal combustion engine as in claim 1 wherein the position of the scavenging port is fully opened and starting to close whereby the baffle means has directed the scavenging air upwards filling and purging the cylinder chamber and surging downward into the cylinder chamber to the multiple exhaust ports thoroughly scavenging and providing clean oxygen laden air to receive the incoming fuel as the pressure retaining valve starts to open and together the scavenging auxiliary air and the incoming fuel charge continue to force residue out the multiple exhaust ports as the exhaust ports are closing.

8. A reciprocating two-stroke internal combustion engine as in claim 1, wherein said means for keeping the fuel supply line and scavenging line under pressure comprises a continuously operating pressure impeller means in operating relationship with the piston, said pressure impeller means being in said fuel-air mixture supply line and said scavenging air line.

9. A reciprocating two-stroke internal combustion engine as in claim 8, wherein the pressure impeller units comprise a vertical pressure impeller thereof in the fuel-air supply line and an inverted pressure impeller thereof in the scavenging air line.

10. A reciprocating two-stroke internal combustion engine as in claim 1, wherein said rotary metering pressure boosters each comprise a housing having a booster chamber with a cylindrical wall and a rotor member of a diameter smaller than said booster chamber and rotatably mounted in said booster chamber, axes of the booster chamber and rotor member being offset with respect to each other, and an extendable and retractable blade means carried by said rotor member and extendable into engagement with the wall of said booster chamber whereby to establish the metered capacity of said rotary metering pressure booster.

11. A reciprocating two-stroke internal combustion engine as in claim 10, wherein there is a vein in the wall of each booster chamber extending from the port exiting therefrom in the same direction as the direction of travel of the blade means whereby to inhibit pressure buildup.

12. A reciprocating two-stroke internal combustion engine as in claim 10, wherein there is an inlet port in the wall of each booster chamber and a vein in the wall of each booster chamber extending upstream from said inlet port in the opposite direction from the direction of travel of said blade means whereby to inhibit vacuum effect.

13. A reciprocating two-stroke internal combustion engine as in claim 1, wherein said piston has compression ring means at the end adjacent the piston head and ring means at the end opposite therefrom providing a non-ringed portion therebetween, said scavenging air port having a location in communication with said non-ringed portion during a substantial portion of the piston stroke whereby a portion of the scavenging air from the respective rotary pressure booster when under pressure skirts around the piston to the multiple exhaust ports thereby performing a valuable aid in cooling.

14. A reciprocating two-stroke internal combustion engine as in claim 1, wherein there is a baffle on the head of said piston in communication with said scavenging ports at the end of each power stroke, said baffle being spaced from the wall of the cylinder in traverse alignment with the scavenging air port whereby to deflect scavenging air upward into said cylinder chamber.

15. A reciprocating two-stroke internal combustion engine as in claim 1, wherein there is provided a pressure retaining chamber for fuel-air mixture in the engine head above the cylinder chamber, a pressure retaining valve in the head means comprising a valve seat in a transverse orientation in the cylinder chamber below said retaining chamber, and a valve guide means mounted on said engine head above said retaining chamber, a valve closing spring means acting between the exterior of engine head and the keeper on end of the valve stem holding the pressure retaining valve in closed position against buildup in said pressure retaining chamber, said valve opening with air flow by mechanical means.

16. A reciprocating two-stroke combustion engine as in claim 9, wherein the said vertical pressure impeller provides a continual means for thoroughly mixing, churning and dispersing said fuel-air mixture into gaseous particles while under pressure creating a volatile gaseous fuel-air mixture.

17. A reciprocating two-stroke combustion engine as in claim 15 wherein the said rotary metering pressure booster F provides an invaluable means of compressing the said volatile fuel-air mixture a second time in said retaining chamber until peak pressure is attained, then releasing said volatile fuel expanding, creating a real cold effect through compression and expansion, and at the same time further cracking and cooling said volatile fuel increasing volatility, lightness, thus more readily vaporized, in preparation for a third and final compression in the combustion chamber before ignition.

18. A reciprocating two-stroke combustion engine as in claim 1, wherein the said inverted pressure impeller in conjunction with said rotary metering pressure booster H provides an indispensable means for supplying a metered amount of auxiliary air under pressure, and sequentially delivering said air into the cylinder chamber, expanding and thereby creating a means of supplying real cold air through compression and expansion for scavenging and cooling the cylinders of both Otto-cycle engine and Diesel machine from within.

19. A reciprocating two-stroke combustion engine as in claim 18 wherein the said indispensable means comprises a means for supplying real cold air through compression and expansion for scavenging and cooling cylinders from within, whereby the said invaluable means is productive of a cool running, air-cooled, Otto-cycle and/or Diesel engine operation while under heavy load.

20. A reciprocating two-stroke combustion engine as in claim 18 wherein the inverted pressure impeller is in operating association with said rotary metering pressure booster H for increasing engine initial compression as engine speed is increased, said means having a fluctuating action relative to engine speed delivering a metered predetermined quantity of air at a predetermined pressure through a given size port into cylinder chamber for scavenging and cooling whereby as engine speed and piston travel speed overtakes and surpasses the travel speed of the incoming air and a portion of the air will be trapped in the cylinder chamber and is compressed together with the incoming fuel increasing the initial compression before ignition ad whereby more air will be trapped as engine speed is increased, gradually increasing initially compression in combustion chamber until the levelling off point is reached, the said levelling off being governed by the said predetermined quantity of air provided, whereby subsequent thereto and regardless of further increased engine speed the initial compression gained will be retained.

21. A reciprocating two-stroke combustion engine as in claim 16 for a Diesel engine wherein the volatile fuel-air mixture is air, and the fuel is injected into the combustion chamber just before ignition.

22. A reciprocating two-stroke combustion engine as in claim 16 for an Otto-cycle engine wherein the fuel is a volatile gaseous fuel-air mixture, and said ignition is produced by an electric spark.

* * * * *